US006360377B2

(12) United States Patent
Sollami

(10) Patent No.: US 6,360,377 B2
(45) Date of Patent: Mar. 26, 2002

(54) FILTRATION HOUSING UNIT FOR USE WITH A VENTILATED TOILET SEAT

(76) Inventor: Jimmie L. Sollami, 1017 Weaver Rd., Herrin, IL (US) 62948

( * ) Notice: Subject to any disclaimer, the term of this patent is extended or adjusted under 35 U.S.C. 154(b) by 0 days.

(21) Appl. No.: 09/877,594

(22) Filed: Jun. 8, 2001

Related U.S. Application Data

(63) Continuation-in-part of application No. 09/713,370, filed on Nov. 15, 2000, now Pat. No. 6,298,500, which is a continuation-in-part of application No. 09/456,706, filed on Dec. 9, 1999, now Pat. No. 6,167,576, which is a continuation-in-part of application No. 09/121,213, filed on Jul. 23, 1998, now abandoned, which is a continuation-in-part of application No. 08/898,048, filed on Jul. 22, 1997, now abandoned, which is a continuation-in-part of application No. 08/774,870, filed on Dec. 19, 1996, now abandoned.

(51) Int. Cl.[7] ..... E03D 9/052
(52) U.S. Cl. ..... 4/213
(58) Field of Search ..... 4/213, 216, 217

(56) References Cited

U.S. PATENT DOCUMENTS

| | | | | |
|---|---|---|---|---|
| 2,238,461 A | * | 4/1941 | Carman | 4/213 |
| 2,847,682 A | * | 8/1958 | Shay | 4/213 |
| 3,491,382 A | * | 1/1970 | Poister | 4/217 |
| 3,763,505 A | | 10/1973 | Zimmerman | |
| 3,781,923 A | | 1/1974 | Maisch et al. | |
| 3,913,150 A | | 10/1975 | Poister et al. | |
| 4,011,608 A | | 3/1977 | Pearson | |
| 4,031,574 A | | 6/1977 | Werner | |
| 4,044,408 A | | 8/1977 | Pearson | |
| 4,117,559 A | | 10/1978 | Boyle | |
| 4,153,956 A | | 5/1979 | Fischer, Sr. et al. | |
| 4,365,361 A | * | 12/1982 | Sanstrom | 4/216 |
| 4,556,999 A | | 12/1985 | Lindley | |
| 4,726,078 A | | 2/1988 | Carballo et al. | |
| 5,345,617 A | | 9/1994 | Jahner et al. | |
| 5,454,122 A | * | 10/1995 | Bergeron | 4/213 X |
| 5,539,937 A | | 7/1996 | Barefoot | |

* cited by examiner

*Primary Examiner*—Charles E. Phillips
(74) *Attorney, Agent, or Firm*—Pitts & Brittian, P.C.

(57) ABSTRACT

A filtration housing unit for use with a ventilated toilet seat. The filtration housing unit is designed for filtering air evacuated from a toilet using the ventilated toilet seat. The housing is configured to be mounted on a wall behind a toilet and under the toilet tank such that it is substantially concealed from view. At least one evacuation hose is attached to the underneath of the housing and extends to the ventilated toilet seat to establish fluid communication from the interior of the toilet bowl to the interior of the housing. The housing is provided for enclosing the components of a fan assembly for drawing the noxious odors from within the toilet bowl. At least one hose receptacle is provided for receiving the proximal end of at least one hose. Each hose is provided with an enlarged radius at the proximal end thereof, and is fabricated from a flexible material such as plastic. An air filter is carried within the housing to condition air. A fan is provided within the housing to draw air from within the toilet bowl, through the hoses to the interior of the housing, and through the filter. In order to maintain the position of the filter within the housing, at least one filter support is provided. The end panel is removable in or to facilitate maintenance of the components within the housing.

13 Claims, 2 Drawing Sheets

FILTRATION HOUSING UNIT FOR USE WITH A VENTILATED TOILET SEAT

CROSS-REFERENCE TO RELATED APPLICATIONS

This application is a Continuation-In-Part of Ser. No. 09/713,370, filed on Nov. 15, 2000, now U.S. Pat. No. 6,298,500 which is a Continuation-In-Part of Ser. No. 09/456,706, filed on Dec. 9, 1999, which issued as U.S. Pat. No. 6,167,576 on Jan. 2, 2001, and which is a Continuation-In-Part of Ser. No. 09/121,213, filed on Jul. 23, 1998, now abandoned, which is a Continuation-In-Part of Ser. No. 08/898,048, filed on Jul. 22, 1997, now abandoned, which is a Continuation-In-Part of Ser. No. 08/774,870, filed on Dec. 19, 1996, now abandoned.

STATEMENT REGARDING FEDERALLY SPONSORED RESEARCH OR DEVELOPMENT

Not Applicable.

BACKGROUND OF THE INVENTION

1. Field of Invention

This invention relates to the field of toilet ventilation. More specifically, the present invention relates to the construction of a filtration housing used in association with a ventilated toilet seat.

2. Description of the Related Art

The need for ventilating a toilet bowl has long been recognized. Accordingly, many devices have been developed to provide such a function. Several devices of the prior art have been discussed in my earlier filed application for patent, which issued as U.S. Pat. No. 6,167,576 on Jan. 2, 2001. In the '575 patent is disclosed a unique ventilated seat construction. Also disclosed are several different methods for processing the air vented from within the toilet, including releasing it to the atmosphere on the exterior of the structure in which the toilet is placed, and filtering the air and reintroducing it to the interior of the structure. Of interest in the present disclosure is the embodiment wherein the vented air is filtered and released into the room in which the toilet is placed.

Other devices in the prior art provide for the filtering and reintroduction of vented air. Typical of the art are those devices disclosed in the following U.S. patents and foreign patent documents:

| Pat. No. | Inventor(s)/(Country) | Issue Date |
|---|---|---|
| 3,763,505 | J. P. Zimmerman | Oct. 9, 1973 |
| 3,781,923 | H. Maisch et al. | Jan. 1, 1974 |
| 3,913,150 | C. E. Poister et al. | Oct. 21, 1975 |
| 4,011,608 | R. H. Pearson | Mar. 15, 1977 |
| 4,031,574 | F. D. Werner | June 28, 1977 |
| 4,044,408 | R. H. Pearson | Aug. 30, 1977 |
| 4,117,559 | D. D. Boyle | Oct. 3, 1978 |
| 4,153,956 | R. C. Fischer, Sr. et al. | May 15, 1979 |
| 4,365,361 | G. H. Sanstrom | Dec. 28, 1982 |
| 4,556,999 | J. E. Lindley | Dec. 10, 1985 |
| 4,726,078 | R. A. Carballo et al. | Feb. 23, 1988 |
| 5,345,617 | J. F. Jahner et al. | Sept. 13, 1994 |
| 5,539,937 | R. E. Barefoot | July 30, 1996 |
| 2,622,228 | Vachey (France) | April 28, 1989 |

Of these devices, several require modification of a conventional toilet or toilet arrangement. The '505 patent issued to Zimmerman discloses a blower in a modified tank lid, the blower pulling evacuated air from within the toilet bowl, through the overfill tube within the tank which, for purposes of the '505 invention also serves as an exhaust tube, and through a filter. The '923 patent issued to Maisch et al., is similar to that of Zimmerman in that a blower is carried within the tank lid.

The patents issued to Poister et al. ('150) discloses a toilet configuration in which a blower is received within a compartment defined in a modified tank, or in a housing attached to the bottom of the tank and the rear of the toilet. Werner ('574) discloses a filter device received within the tank and mounted on the overfill pipe. Pearson ('408) also discloses a device whereby exhaust is delivered through a modified overfill pipe. The exhausted air is then evacuated through a filter attached to the outside of the tank. The tank lid is elevated above its normal disposition in order to accommodate the filter unit. Fischer, Sr. et al., ('956) discloses a device similar to that of Pearson.

A number of other patents disclose a filter unit on the exterior of the toilet. Lindley ('999) schematically, with no structural detail, depicts a vacuum source and filter in series on the exterior of the toilet. Pearson ('608) teaches a modified tank, having an air exhaust extending from the top of the volume within the tank to a filter unit disposed on the underneath of the tank. Sanstrom ('361) discloses a filter unit resting on a platform disposed between the toilet and the floor, the platform for directing ventilated air into the sewer system. Carballo et al. ('078), Jahner et al. (617) and Vachey (France '228) each disclose a filter unit disposed externally of the toilet and tank.

The '559 patent issued to Boyle discloses a filter unit integrated within the toilet seat hinge assembly. Similarly, Barefoot ('937) discloses a filter unit integrated with the toilet seat and lid.

BRIEF SUMMARY OF THE INVENTION

The present invention provides a filtration housing unit for use with a ventilated toilet seat. The filtration housing unit is designed for filtering air evacuated from a toilet using the ventilated toilet seat. The housing is configured to be mounted on a wall behind a toilet and under the toilet tank such that it is substantially concealed from view. At least one evacuation hose is attached to the underneath of the housing and extends to the ventilated toilet seat to establish fluid communication from the interior of the toilet bowl to the interior of the housing.

The housing is provided for enclosing the components of a fan assembly for drawing the noxious odors from within the toilet bowl. At least one hose receptacle is provided for receiving the proximal end of at least one hose. Each hose is provided with an enlarged radius at the proximal end thereof, and is fabricated from a flexible material such as plastic.

An air filter or an air freshener is carried within the housing to condition the air for re-introduction into the room. A fan is provided within the housing to draw air from within the toilet bowl, through the hoses to the interior of the housing, and through the filter. After being filtered, the fan reintroduces the air into the room environment. In order to maintain the position of the filter within the housing, at least one filter support is provided. The supports are dimensioned to minimize obstruction in the air flow, and are positioned to provide adequate support to prevent the filter from being pushed out of the airflow, while also accommodating easy removal and replacement thereof.

In order to facilitate maintenance of the fan assembly within the housing, the end panel and at least a portion of the front panel is removable. In the preferred embodiment, the end wall is fabricated from a flexible material and is dimensioned to be slightly smaller in one dimension of the opening in the end of the housing and to be slightly larger in the other dimension. To accommodate the larger dimension of the end panel, each of the opposing walls defines a groove for receiving the end panel, thus providing a means for retaining the end panel.

The housing is mounted to a wall in a conventional fashion, such as with wall anchors.

BRIEF DESCRIPTION OF THE SEVERAL VIEWS OF THE DRAWINGS

The above mentioned features of the invention will become more clearly understood from the following detailed description of the invention when read together with the drawings in which.

DETAILED DESCRIPTION OF THE INVENTION

Figure 1:
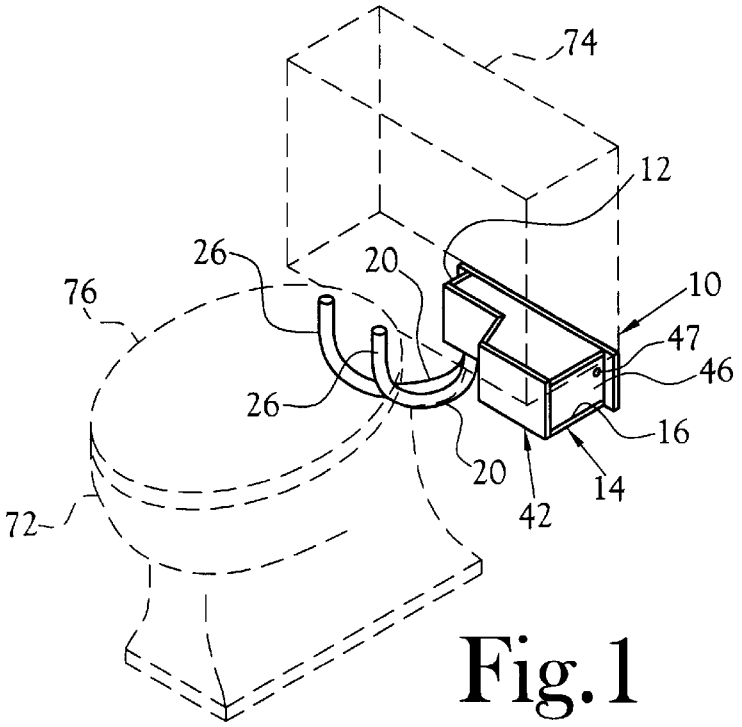
FIG. 1 is a perspective illustration of the filtration housing unit of the present invention used in association with a ventilated toilet seat mounted on a conventional toilet, shown in phantom.

A filtration housing unit for use with a ventilated toilet seat incorporating various features of the present invention is illustrated generally at 10 in the figures. The filtration housing unit, or housing 10, is designed for filtering air evacuated from a toilet 72 using the ventilated toilet seat 76. Further, the housing 10 is designed to be mounted on a wall 70 behind the toilet 72 and under an associated tank 74, when provided such that a substantial portion of the housing 10 is concealed. It will be noted that in commercial use, toilets 72 are often provided with a water supply from a remote location and a resident-type tank 74 as illustrated is not associated with the toilet 72.

Figure 4:
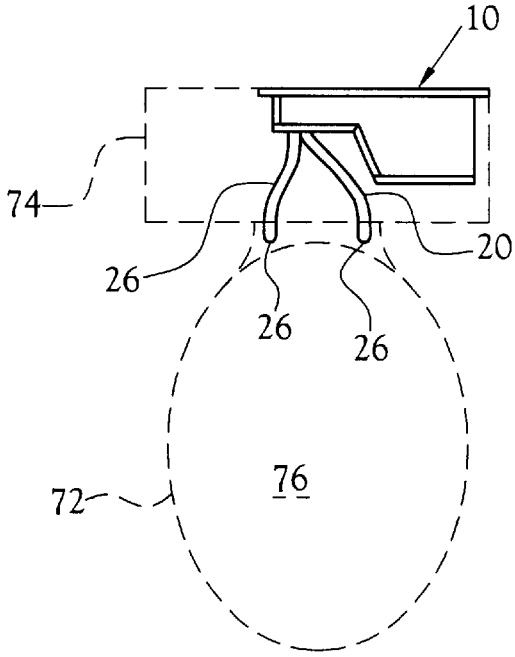
FIG. 4 is a top plan view illustrating the filtration housing unit of FIG. 1.

As illustrated in FIGS. 1 and 4, the housing 10 is configured to be mounted on a wall 70 behind a toilet 72 and under the toilet tank 74 such that it is substantially concealed from view. Although illustrated as being disposed on the right hand side of the toilet 72, it will be understood that the housing 10 of the present invention may be modified to be positioned behind either side of the toilet 72. At least one evacuation hose 20 is attached to the underneath of the housing 10 and extends to the ventilated toilet seat 76. In the illustrated embodiment, two such hoses 20 are provided for evacuating contaminated air from two discrete evacuation channels (not shown) defined by the toilet 72 or toilet seat 76. However, it will be understood that in environments wherein a single evacuation channel is provided, a single hose 20 is required.

Figure 2:
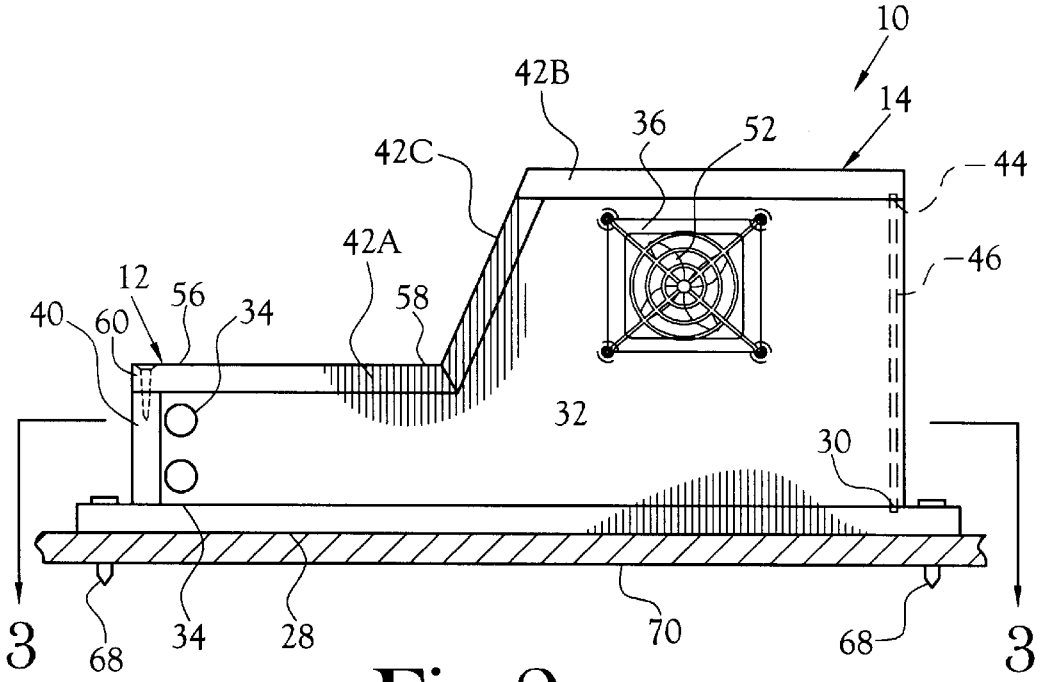
FIG. 2 is a bottom plan view of the filtration housing unit of FIG. 1 being mounted on a wall under the tank of the toilet.

The underneath of the housing 10 is better illustrated in FIG. 2. A rear panel 28 is configured to be mounted on the wall 70. Bottom and top panels 32, 38, a first end panel 40 and a front panel 42 are secured one to another, and to the rear panel 28, to define an interior volume 18 within the housing 10. In the illustrated embodiment, two hose receptacles 34 are defined in the bottom panel 32 proximate the first end 12 of the housing 10 for receiving the proximal end 22 of each of the two hoses 20. It will be understood that a single hose receptacle 34 may be provided in situations wherein a single hose 20 is required. Further, although not illustrated, a single hose receptacle 34 may be provided where two hoses 20 are coupled in conventional fashion where desired. Also illustrated is a fan 52 for inducing air flow through the housing 10, as is described in greater detail below.

The housing 10 defines a first end 12 having a first depth dimensioned to be received behind a conventional toilet 72. In one embodiment, the first end 12 of the housing 10 defines a depth of approximately three inches (3"). As illustrated and as described above, the hose receptacles 34 are disposed in the bottom panel 32 proximate the first end 12. By disposing the first end 12 of the housing 10 behind the toilet 72, with the hose inlets 34 defined therein, the hoses 20 are directly routed from underneath the toilet seat 76 to a point behind the toilet 72, under the tank 74, and under the housing 10, thereby concealing a substantial portion of the hoses 20. The second end 14 of the housing 10, in the illustrated embodiment, defines a larger depth in order to better facilitate maintenance of the interior components of the housing 10, as further described below. In the above embodiment, the depth of the second end 14 of the housing 10 is approximately six and one-half inches (6½"). In this embodiment, the front panel 42 is segmented into a first end front panel 42A, a second end front panel 42B and a transition portion front panel 42C interposed between the first and second end front panel portions 42A, B. It is preferable that the depth of the second end 14 of the housing 10 be less than the dimension from the front of the tank 74 to the wall 70 such that the housing 10 remains substantially concealed. Further, the length of the housing 10 is preferably dimensioned to be substantially received under the tank 74. Because these dimensions may be varied with success, it will be understood that the present invention is not intended to be limited to these dimensions.

As illustrated, the housing 10 is mounted to a wall 70 in a conventional fashion, such as with wall anchors 68. The selected mounting device will depend upon the application and need for security from theft or vandalism. It will be understood that the present invention is not intended to be limited by the specific type of conventional fastener chosen to mount the housing 10.

Figure 3:
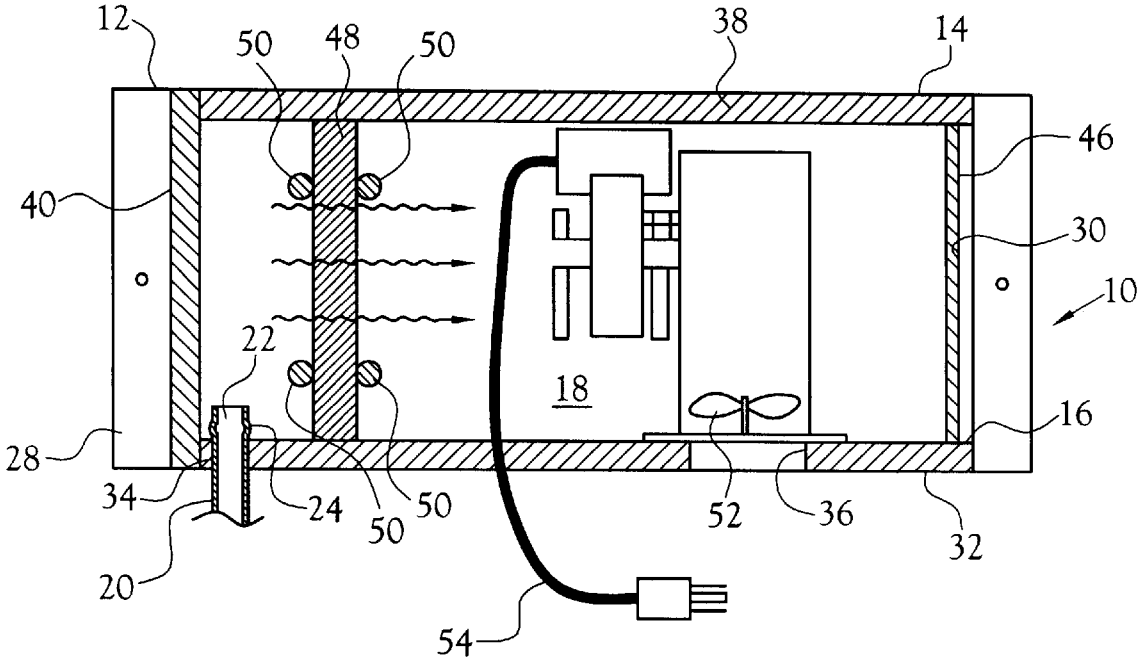
FIG. 3 is a front elevation view, in section taken at 3—3 of FIG. 2, illustrating one disposition of the internal components of the filtration system used in association with a ventilated toilet seat.

As illustrated most clearly in FIG. 3, the housing 10 is provided for enclosing the components of a fan assembly for drawing the noxious odors from within the toilet 72. In the illustrated embodiment, each hose 20 is provided with an enlarged radius 24 at the proximal end 22 thereof, and is fabricated from a flexible material such as plastic. Thus, the proximal end 22 of the hose is inserted into the hose receptacle 34 until the enlarged radius 24 is received therein. The enlarged radius 24 then serves to maintain the proximal end 22 of the hose 20 within the hose receptacle 34. To this extent, the hose receptacle 34 is dimensioned to be substantially equal to the outside diameter of hose 20. With the distal end 26 of each hose 20 connected to the ventilated toilet seat 76 as described, the interior volume 18 of the housing 10 is in fluid communication with the interior of the toilet 72.

An air filter 48 or an air freshener is carried within the housing 10 to condition the air for re-introduction into the room. A fan 52 is provided within the housing 10 to draw air from within the toilet 72, through the hoses 20 to the interior volume 18 of the housing 10, and through the filter 48. After being filtered, the fan 52 reintroduces the air into the room environment through an outlet 36 defined in the bottom panel 32. The fan 52 is powered as indicated by a conventional electric cord 54. However, it will be understood that other means for powering the fan 52 may be effectively incorporated as well, such as a battery, or by other sources of alternative electricity such as solar power. Activation of the fan 52 for recycling of the contaminated air within the toilet 72 is accomplished by any conventional means, such as by a pressure activated switch on the toilet seat, an ON/OFF switch, remote control, or a motion sensor.

In order to maintain the position of the filter 48 within the housing 10, at least one filter support 50 is provided. In the illustrated embodiment, two filter supports 50 are disposed on either side of the filter 48, each being an elongated member extending between two opposing walls of the housing 10. The supports 50 are dimensioned to minimize obstruction in the air flow, and are positioned to provide adequate support to prevent the filter 48 from being pushed in either direction out of the airflow, while also accommodating easy removal and replacement thereof.

In the illustrated embodiment, in order to provide access to the filter 48 for removal and replacement, the first end front panel 42A is removable. To this extent, the transition portion front panel 42C and the first end front panel 42A engage in mating fashion to maintain the position of the distal end 58 of the first end front panel 42A. At least one removable fastener 60 is provided for securing the proximal end 58 of the first end front panel 42A. Removal of the first end front panel 42A is thus accomplished by removing the fasteners 60 and lifting the first end front panel 42A away.

In order to facilitate maintenance of the fan assembly within the housing 10, the second end panel 46 is removable. In the preferred embodiment, the second end panel 46 is fabricated from a flexible material and is dimensioned to be slightly smaller in one dimension (illustrated in FIG. 3) of the opening 16 in the second end 14 of the housing 10 and to be slightly larger in the other dimension (illustrated in FIG. 2). In the illustrated embodiment, to accommodate the larger dimension of the second end panel 46, each of the rear and front panels defines a groove 30, 44, respectively, shown in phantom in FIG. 2, for receiving the second end panel 46, thus providing a means for retaining the second end panel 46. It will be understood that other means of access to the interior volume 18 of the housing 10 may be provided as well. In the illustrated embodiment, as most clearly seen in FIG. 1, the second end panel 46 defines an opening 47 for cooling the fan 52. It will be understood that the opening 47 may be defined in other locations of the housing 10 as well. Although not illustrated, in an alternate embodiment, the second end panel 46 defines a grate.

From the foregoing description, it will be recognized by those skilled in the art that a construction for a filtration housing for use with a ventilated toilet seat assembly offering advantages over the prior art has been provided. Specifically, the filtration housing unit is designed for filtering air evacuated from a toilet using the ventilated toilet seat. Further, the housing is designed to be mounted on a wall behind the toilet and under the associated tank such that a substantial portion of the housing is concealed.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A filtration housing unit for use with a ventilated toilet seat, the ventilated toilet seat including at least one evacuation hose for evacuating contaminated air from within a toilet bowl, the evacuation hose defining an enlarged portion at its proximal end, said filtration housing unit comprising:

a rear panel configured to be mounted on a wall behind a toilet such that a substantial portion of said housing is concealed;

a bottom panel carried by said rear panel, said bottom panel defining at least one hose receptacle being adapted to receive the proximal end of said at least one evacuation hose to establish fluid communication between said housing and the toilet bowl, said bottom panel further defining an outlet for evacuating filtered air;

a top panel carried by said rear panel above said bottom panel;

a first end panel carried by said rear panel and secured to each of said bottom panel and said top panel;

a front panel, mounted to each of said bottom panel, said top panel, and said first end panel to define an interior volume therein, said rear panel, said bottom panel, said top panel, and said front panel cooperating to define an opening at a second end of said housing;

a second end panel configured to substantially cover said opening at said second end of said housing, said second end panel being removable to facilitate access to said interior volume;

said rear panel having portions extending beyond a point of contact of said first and second panels to provide locations for the receipt of wall anchors an air filter disposed within said interior volume to condition air;

at least one filter support for retaining said air filter, each of said at least one filter support being an elongated member mounted within said housing; and a fan disposed within said interior volume to draw air from within the toilet bowl, through the at least one evacuation hose to said interior volume of said housing, through said air filter, and through said outlet.

2. The filtration housing unit of claim 1 wherein said housing defines a first depth at said first end and a second depth at said second end, said first depth being adapted to be received behind a conventional toilet, whereby said at least one hose receptacle is disposed behind the toilet bowl, said front panel including a first end front panel, a second end front panel and a transition portion front panel interposed between said first end front panel and said second end front panel.

3. The filtration housing unit of claim 2 wherein said first end front panel is removable for removal and replacement of said air filter.

4. The filtration housing unit of claim 1 wherein said rear panel and said front panel define cooperating grooves, wherein said second end panel is fabricated from a flexible material and is dimensioned to be closely received between said top panel and said bottom panel, and to closely received within said cooperating grooves defined by said rear panel and said front panel.

5. The filtration housing unit of claim 1 wherein said at least one filter support includes at least one filter support disposed on a first side of said air filter and at least one filter support disposed on a second side of said air filter.

6. The filtration housing unit of claim 1 wherein one of said bottom panel, said top panel, said front panel and said second end panel defines a fan vent opening for cooling said fan.

7. The filtration housing unit of claim 6 wherein said second end panel defines said fan vent opening.

8. The filtration housing unit of claim 1 wherein a tank is associated with and disposed above the toilet, wherein said rear panel is disposed beneath the tank.

9. A filtration housing unit for use with a ventilated toilet seat, the ventilated toilet seat including at least one evacuation hose for evacuating contaminated air from within a toilet bowl, the evacuation hose defining an enlarged portion at its proximal end, said filtration housing unit comprising:

a rear panel configured to be mounted on a wall behind a toilet and under an associated tank such that a substantial portion of said housing is concealed;

a bottom panel carried by said rear panel, said bottom panel defining at least one hose receptacle being adapted to receive the proximal end of at least one evacuation hose to establish fluid communication between said housing and the toilet bowl, said bottom panel further defining an outlet for evacuating filtered air;

a top panel carried by said rear panel above said bottom panel;

a first end panel carried by said rear panel and secured to each of said bottom panel and said top panel;

a front panel, mounted to each of said bottom panel, said top panel, and said first end panel to define an interior volume therein, said rear panel, said bottom panel, said top panel, and said front panels cooperating to define an opening at a second end of said housing, said housing defining a first depth at said first end and a second depth at said second end, said first depth being adapted to be received behind a conventional toilet, whereby said at least one hose receptacle is disposed behind the toilet bowl, said front panel including a first end front panel, a second end front panel and a transition portion front panel interposed between said first end front panel and said second end front panel, said first end front panel being removable for removal and replacement of said air filter;

a second end panel configured to substantially cover said opening at said second end of said housing, said second end panel being removable to facilitate access to said interior volume, said rear panel and said front panel define cooperating grooves, wherein said second end panel is fabricated from a flexible material and is dimensioned to be closely received between said top panel and said bottom panel, and to closely received within said cooperating grooves defined by said rear panel and said front panel;

an air filter disposed within said interior volume to condition air;

at least one filter support for retaining said air filter, each of said at least one filter support being an elongated member mounted within said housing; and a fan disposed within said interior volume to draw air from within the toilet bowl, through the at least one evacuation hose to said interior volume of said housing, through said air filter, and through said outlet.

10. The filtration housing unit of claim 9 wherein said at least one filter support includes at least one filter support disposed on a first side of said air filter and at least one filter support disposed on a second side of said air filter.

11. The filtration housing unit of claim 9 wherein one of said bottom panel, said top panel, said front panel and said second end panel defines a fan vent opening for cooling said fan.

12. The filtration housing unit of claim 11 wherein said second end panel defines said fan vent opening.

13. The filtration housing unit of claim 9 wherein a tank is associated with and disposed above the toilet, wherein said rear panel is disposed beneath the tank.

* * * * *